United States Patent [19]

Kimura

[11] 4,329,619

[45] May 11, 1982

[54] DIRECT-VIEW STORAGE TUBE WITH MULTIPLE PATH TARGET ELECTRODE

[75] Inventor: Masamichi Kimura, Ibaraki, Japan

[73] Assignee: Matsushita Electronics Corporation, Osaka, Japan

[21] Appl. No.: 149,013

[22] Filed: May 12, 1980

[30] Foreign Application Priority Data

May 18, 1979 [JP] Japan ..... 54-61861
Jun. 20, 1979 [JP] Japan ..... 54-77796

[51] Int. Cl.[3] ..... H01J 29/10; H01J 29/28

[52] U.S. Cl. ..... 313/470

[58] Field of Search ..... 313/403, 408, 461, 470, 313/471

[56] References Cited

U.S. PATENT DOCUMENTS 3,939,486 2/1976 Tomii ..... 313/471

*Primary Examiner*—Eli Lieberman
*Attorney, Agent, or Firm*—Burgess, Ryan and Wayne

[57] ABSTRACT

In a bistable direct-view storage tube capable of storing two different images simultaneously and displaying them in different colors, a target electrode or a storage surface comprising an array of red-light-emitting phosphor strips, an array of green-light-emitting phosphor strips interlaced or interleaved with the red-light-emitting phosphor strips, first and second conductor films in the form of a comb with each tooth surrounding each of the phosphor strips and being in electrical contact therewith, each tooth being in the form of a ladder with parallel-side-piece strips and cross-piece strips which divide each phosphor strip into a plurality of substantially equally spaced phosphor lands, whereby every phosphor land can be kept impressed with a predetermined bias voltage even when any of the teeth is electrically damaged.

3 Claims, 3 Drawing Figures

DIRECT-VIEW STORAGE TUBE WITH MULTIPLE PATH TARGET ELECTRODE

BACKGROUND OF THE INVENTION

The present invention relates to a bilateral direct-view storage tube capable of reproducing in different color two images stored on a common storage surface.

In the bistable direct-view storage tubes, writing, reading and erasing of the images are effected by the utilization of the charge storage and light-emitting capabilities of insulating phosphors.

The same inventor disclosed in Japanese Patent Application Laid-Open No. 51-132962, and bilateral direct-view storage tube capable of simultaneously storing two different images and displaying them in different color. The target electrode or a common storage surface comprises a first array of red-light-emitting phosphor strips, a second array of green-light-emitting phosphor strips interleaved or interlaced with the red-light-emitting phosphor strips and first and second comb-shaped conductor films each having a plurality of teeth each surrounding each of the corresponding phosphor strips in electrical contact relationship therewith. However, when any of the teeth is electrically damaged at more than two points, the portion of the phosphor strip surrounded by the disconnected portion of the tooth is not impressed with a predetermined bias voltage. As a result, the image quality such as resolution and the image intensity are adversely affected.

SUMMARY OF THE INVENTION

In view of the above, the primary object of the present invention is to provide a bistable direct-view storage tube which may substantially overcome the defect described above.

Briefly stated, to the above and other ends, the present invention provides a bistable direct-view storage tube in which first and second conductor films, which surround first and second interlaced or interleaved phosphor strips, are in the form of a comb having a plurality of teeth each of which is in the form of a ladder with parallel-side-piece strips and a plurality of cross-piece strips which in turn divides each of the phosphor strips into a plurality of substantially equally spaced phosphor lands, whereby unless the opposing side-piece strips surrounding the same phosphor land are electrically damaged, all the phosphor lands can be kept applied with a predetermined bias voltage.

The above and other objects, effects, features and advantages of the present invention will become more apparent from the following description of preferred embodiments thereof taken in conjunction with the accompanying drawings.

DETAILED DESCRIPTION OF THE PRIOR ART

Figure 1:
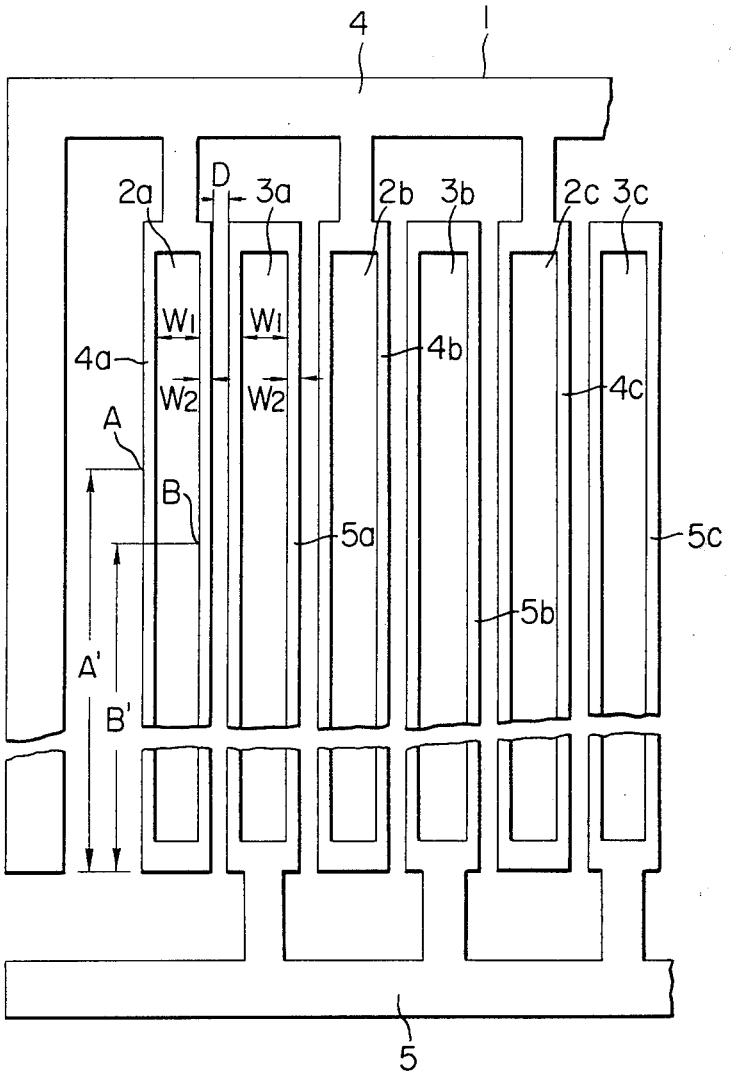
FIG. 1 (PRIOR ART)
FIG. 1 is a fragmentary top view of a target electrode of a prior art direct-view storage tube.

In FIG. 1 is shown a target electrode 1 of a prior art direct-view storage tube which is deposited on the inside surface of a faceplate in opposed relationship with a high-velocity writing electron gun and a low-velocity reading electron gun. The target electrode includes a plurality of red-light-emitting electroluminescent phosphor strips 2*a*, 2*b*, 2*c* and so on and a plurality of green-light-emitting electroluminescent phosphor strips 3*a*, 3*b*, 3*c* and so on which are interleaved and first and second comb-shaped conductor films 4 and 5 made of graphite or the like. The teeth 4*a*, 4*b*, 4*c* and so on of the first conductor film 4 surround the red-light-emitting strips 2*a*, 2*b*, 2*c* and so on and are brought into electrical contact with them. In the like manner, the teeth 5*a*, 5*b*, 5*c* and so on of the second conductor film 5 surround the green-light-emitting strips 3*a*, 3*b*, 3*c* so on and are brought into electrical contact with them.

The red-light-emitting strips 2*a*, 2*b*, 2*c* and so on are formed by the deposition of for example $Zn_3(PO_4)_2$:Mn while the green-light-emitting strips 3*a*, 3*b*, 3*c* and so on by the deposition of $ZnSiO_4$:Mn. The strips 2 and 3 have the width $W_1$ of about 50 $\mu$m while both the width $W_2$ of the teeth 4*a*, 4*b*, 4*c* and so on and 5*a*, 5*b*, 5*c* and so on and the spacing D between them are about 30$\mu$.

In the writing mode, a high DC voltage of about 3 KV is impressed between the cathode of the writing gun and the first conductor film 4 which is the collector electrode, the cathode being more negative than the collector electrode. The target electrode 1 is scanned by the high-velocity electron beam which is modulated by a first video signal so that the red-light-emitting strips 2*a*, 2*b*, 2*c* and so on are excited and a large number of secondary charge carriers are produced, whereby the red-light-emiting strips 2*a*, 2*b*, 2*c* and so on are charged positive. However, the strips which have not been excited by the high-velocity electron beam remain negative. Thus, a positive electrostatic latent image corresponding to a first image is stored on the storage surface consisting of the red-light-emitting strips 2*a*, 2*b*, 2*c* and so on.

The secondary charge carriers are trapped by the first conductor film 4.

In the reading mode, a DC voltage of about 150 V is impressed between the cathode of a reading gun and the first thin film 4 with the cathode driven more negative than the thin film 4, so that the flood beam impinges on the target electrode 1. Then, the red-light-emitting strips 2 which have been excited by the bombardment of the high-velocity electron beam emit red light, whereby the first image is reproduced. The stored image can be erased by dropping the voltage applied to the first conductor thin film 4.

In order to write a second image on the target electrode 1 on which the first image has been already stored, a high DC voltage of about 3 KV is impressed between the cathode of the writing gun and the first and second thin films 4 and 5 with the cathode driven more negative than the thin film 4 and 5. The second image can be stored in a manner substantially similar to that described above.

As described above, the red-light-emitting phosphor strips 2*a*, 2*b*, 2*c* and so on and the green-light-emitting phosphor strips 3*a*, 3*b*, 3*c* and so on serve as the first and second storage surfaces, respectively, so that both the first and second images can be stored on the common target electrode 1 bilaterally. In the case of reading the first image, the DC voltage about 150 V is applied between the reading gun and the first thin film 4 with the cathode of the reading gun being more negative than the thin film 4, the first image can be reproduced in red color. In the case of reading the second image, a DC voltage is applied between the cathode of the reading gun and the first and second thin films 4 and 5 so that the second image which has been stored not only in the red-light-emitting phosphor strips 2*a*, 2*b*, 2*c* and so on but also in the green-light-emitting phosphor strips 3*a*, 3*b*, 3*c* and so on can be reproduced in a yellow color resulting from the addition of red and green light. Thus, the second image can be distinctly distinguished from the first image in red color.

However, the teeth 4*a*, 4*b*, 4*c* and so on and 5*a*, 5*b*, 5*c* and so on of the first and second conductor thin films 4 and 5 are in the form of an extremely fine and extremely elongated rectangle. Therefore, when any of them is scratched, stripped or otherwise disconnected at more than two portions as indicated at A and B, the portions A' and B' are not supplied with the current so the region of the phosphor strip 2*a* adjacent to these portions A' and B' becomes incapable of storing the image. In order to overcome this problem, there may be proposed a scheme for enlarging the width $W_2$ of the teeth 4*a*, 4*b*, 4*c* and so on and 5*a*, 5*b*, 5*c* and so on, but the decrease in surface area of the phosphor strips 2 and 3 inevitably results so that the image quality is degraded and at the same time the image intensity is lowered to a considerable degree.

DESCRIPTION OF THE PREFERRED EMBODIMENTS

Figure 2:
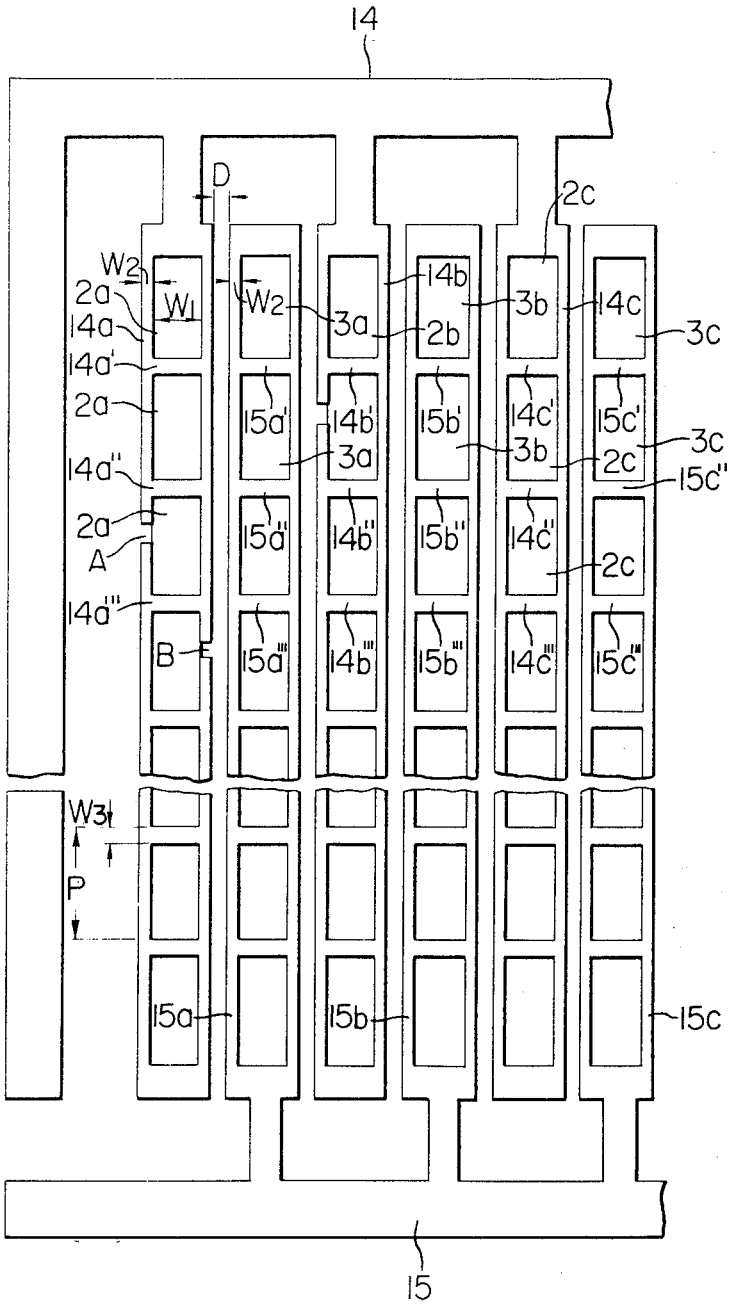
FIGS. 2 and 3 are fragmentary top views, respectively, of first and second embodiments of the present invention.

First Embodiment, FIG. 2

In FIG. 2 is shown a first embodiment of the present invention. A first comb-shaped conductor thin film 14 has a plurality of teeth 14*a* through 14*n* each of which is in the form of a ladder with two parallel side pieces and a plurality of cross pieces 14*a'*, etc. The width $W_3$ of the cross pieces 14*a'*, etc. is at least two times as great as the width $W_2$ of the side pieces. The parallel side pieces and cross pieces surround the red-emitting phosphor lands 2*a* through 2*n* and are brought into electrical contact with them.

In like manner, a second comb-shaped conductor thin film 15 has a plurality of teeth 15*a* through 15*n* each of which is also in the form of ladder with two parallel side pieces and a plurality of cross pieces 15*a'*, etc. The width $W_3$ of the cross pieces 15*a'*, etc. is at least twice as great as the width $W_2$ of the side pieces. The side and cross pieces also surround the green-light-emitting phosphor lands 3*a* through 3*n* and are brought into electrical contact therewith.

The pitch of the cross pieces is 0.3 mm at the most and preferably, between 0.2 and 0.3 mm. It should be noted that when the pitch P exceeds 0.3 mm, the secondary charge carrier trapping capabilities are adversely affected.

As described above, both the first and second thin films 14 and 15 have the teeth in the form of a ladder. Therefore, even when any of the teeth is stripped, scratched or otherwise disconnected at more than one point as indicated at A and B, these teeth can be kept impressed with a predetermined bias voltage unless the disconnections occur at the opposing side pieces surrounding the same phosphor land 2*a*. As a result, the degradation in image quality or resolution and the decrease in image intensity can be avoided.

In order to fabricate the storage surface of the type described above, the photolithographic processes used in the production of the phosphor dot screens of the color television tubes can be also employed. In this case, according to the present invention, the width $W_3$ of the cross-piece film strips 14*a'*, etc. is at least twice as great as the width $W_2$ of the side-piece thin film strips so that the cross-piece film strips remain uncovered with the phosphor lands 14*a*, etc. As a result, the effective trapping of secondary charge carriers can be ensured.

Figure 3:
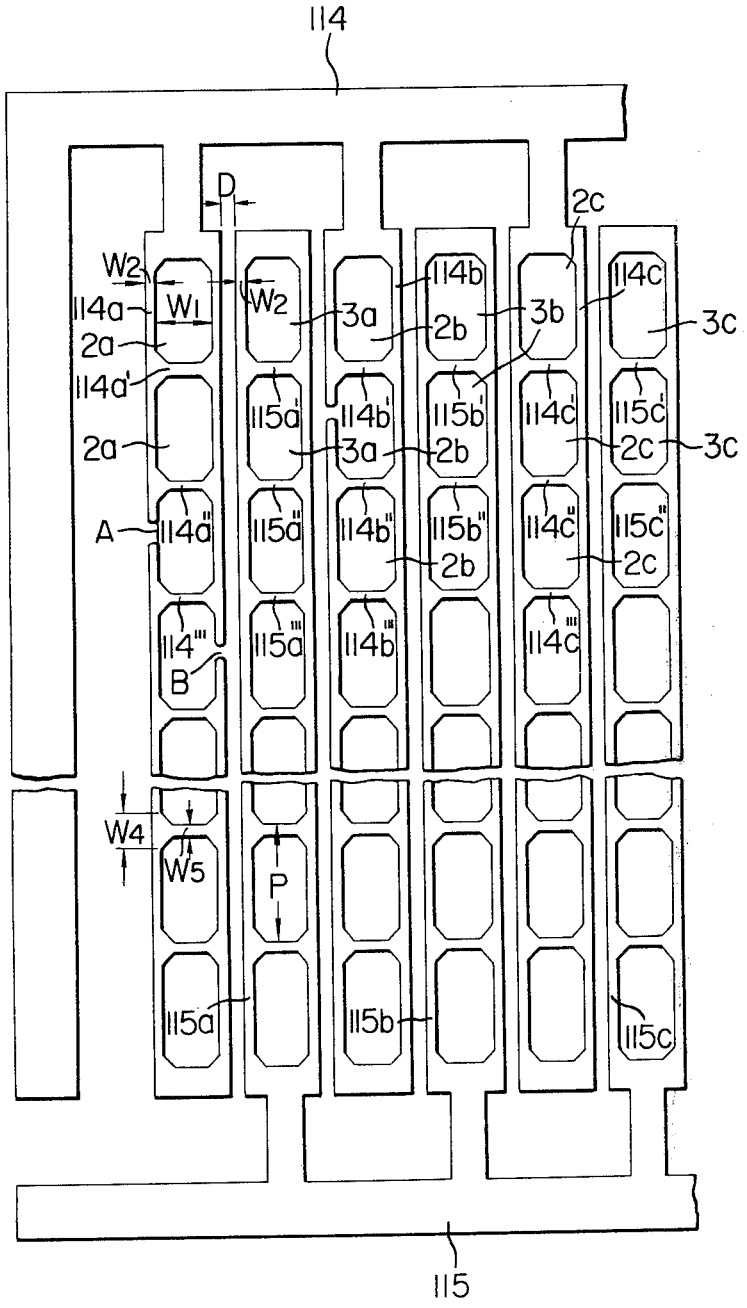

Second Embodiment, FIG. 3

A second embodiment shown in FIG. 3 is substantially similar in construction to the first embodiment just described above with reference to FIG. 2 except that the four corners of each of the phosphor lands 14*a*, etc. are cut off or tapered in such a way that the spacing $W_4$ between the sides of the adjacent phosphor lands; that is, the end width of the cross-piece film strip 14*a'* *become considerably greater than the intermediate width* $W_5$, whereby the overall surface area of each of the first and second conductor films 14 and 15 can be increased. As a result, the width $W_2$ of the side-piece film strips can be made less than 20 μm. When only the width $W_2$ is reduced less than 20 μm without any other modification, the phosphor lands 14*a*, etc. overlap the side-piece film strips due to the misregistration of a pattern mask or any other cause so that a desired surface area of the first or second film 14 or 15 can not be secured. As a result, the secondary charge carrier trapping capabilities of the first and second films 14 and 15 are adversely affected. However, according to the second embodiment of the present invention, the four corners of the phosphor lands 14*a*, etc. are cut off or tapered so that the end width $W_4$ of the cross-piece film strips 14*a'*, etc. can be determined about 30 μm. As a result, the desired overall surface area of the first and second thin films 14 and 15 can be obtained. In addition, the widths $W_2$ and $W_5$ can be reduced as small as about 10 μm.

Table below shows the comparison in dimensional tolerances between the target electrode of the present invention and the prior art. R shows the ratio in surface area between first or second phosphor strips and the target electrode in %. It is seen that the present invention has an R greater than the prior art.

TABLE

| | | Invention | |
|---|---|---|---|
| | prior art | first embodiment | second embodiment |
| $W_1$ | 80 μ | 80 μ | 80 μ |
| $W_2$ | 30 μ | 10 μ | 10 μ |
| $W_4$ | — | 30 μ | 30 μ |
| $W_5$ | — | 30 μ | 10 μ |
| D | 30 μ | 30 μ | 30 μ |
| P | — | 200 μ | 200 μ |
| R | 23.5% | 26.8% | 28.9% |

What is claimed is:

1. A direct-view storage tube characterized by the provision of a target electrode comprising an array of first phosphor strips capable of emitting a first color, an array of second phosphor strips capable of emitting a second color and interlaced or interleaved with said array of first phosphor strips, a first comb-shaped conductor film having a plurality of teeth each of which surrounds each of said first phosphor strips and is brought into electrical contact therewith, a second comb-shaped conductor film having a plurality of teeth each of which surrounds each of said second phosphor strips and is brought into electrical contact therewith, and each of said teeth of said first and second conductor films being in the form of a ladder with parallel-side-piece strips and cross-piece strips which divides each of said first or second phopshor strip into a plurality of phosphor lands.

2. A direct-view storage tube as set forth in claim 1 further characterized in that the width of the cross-piece film strips is at least two times as great as the width of said parallel-side-piece strips.

3. A direct-view storage tube as set forth in claim 1 further characterized in that the end width of said cross-piece film strips is greater than the width of the intermediate portion thereof.

* * * * *